US005137602A

United States Patent [19]

Stewen et al.

[11] Patent Number: 5,137,602

[45] Date of Patent: Aug. 11, 1992

[54] HEATING CHAMBER FOR A COKE OVEN AND METHOD OF HEATING A COKE OVEN

[75] Inventors: Wilhelm Stewen, Oberhausen; Klaus Wessiepe, Essen, both of Fed. Rep. of Germany

[73] Assignee: Dr. C. Otto Feuerfest GmbH, Bochum, Fed. Rep. of Germany

[21] Appl. No.: 650,614

[22] Filed: Jan. 23, 1991

[30] Foreign Application Priority Data

May 23, 1989 [DE] Fed. Rep. of Germany ..... 3916728
May 23, 1990 [DE] Fed. Rep. of Germany ..... PCT/DE90/00384

[51] Int. Cl.[5] ..... C10B 21/10; C10B 21/22

[52] U.S. Cl. ..... 201/41; 202/139; 202/151; 202/222

[58] Field of Search ..... 201/41; 202/139, 151, 202/222, 223; 432/223; 431/356, 2

[56] References Cited

U.S. PATENT DOCUMENTS 1,805,922 5/1931 Otto ..... 202/151
1,891,700 12/1932 Wessel ..... 202/151
4,412,890 11/1983 Thubeauville ..... 202/139

FOREIGN PATENT DOCUMENTS 391501 3/1924 Fed. Rep. of Germany .
655948 1/1938 Fed. Rep. of Germany .
75201 7/1978 Japan ..... 202/151

*Primary Examiner*—Joye L. Woodard
*Attorney, Agent, or Firm*—Thomas N. Ljungman

[57] ABSTRACT

The heating flues in an oven are equipped with refractory components to control the feed and mixture of combustion air and gas into each heating flue. In one embodiment, the refractory component forms a plurality of passageways through which air and gas flow into mixture. Initially, the gas is mixed with small amounts of air to obtain substoichiometric combustion in the refractory component. Additional combustion air is supplied to the resulting partially combusted gases and unburned gas to complete the combustion of air and gas in the heating flue. This arrangement serves to optimize the flame control and the heat discharge over the height of the heating flue. In a second embodiment, the refractory component forms a plurality of passageways through which combustion air is supplied to the gas along the passageway outlets which are located at preselected positions along the length of the heating flue.

20 Claims, 4 Drawing Sheets

HEATING CHAMBER FOR A COKE OVEN AND METHOD OF HEATING A COKE OVEN

BACKGROUND OF THE INVENTION

1. Field of the Invention

This invention relates to a process and an apparatus for selective transportation of combustion media gas and air to a heating chamber, where the gas and combustion air are mixed and burned in controlled amounts. To reduce the level of $NO_x$ pollutants contained in the resulting waste gases, the feed is preferably arranged so that the combustion air is introduced into the combustion chamber at different heights to achieve an initially substoichiometric combustion with the lowest possible temperatures at the flame tip. Gases, such as $NO/NO_2$, accelerate the flame reaction. To compensate for this effect and/or to slow down the flame reaction, waste gas can be introduced. The waste gas or partially combusted gas can be added to and mixed in with the combustion air.

2. Background Information

In ovens where heating chambers are heated by heating flues in the oven walls, uncontrolled flow conditions are a common feature, In some of the known heating chambers, there are pronounced recirculation flows. U.S. Pat. No. 4,412,890 discloses an oven battery that includes heating flues having hollow shaft members formed with orifices at different elevations. The shaft members are connected to regenerators for the supply of preheated gaseous combustion agents. One shaft member is supplied with preheated lean gas, and another shaft is supplied with preheated combustion-supporting air. The shafts are connected to the regenerators. The shafts narrow upwardly in steps. The upwardly-decreasing cross section serves to decrease the quantity of gas issuing from the exit orifices at each orifice further up the flue. On the other hand, the cross sections of the flue chambers widen upwardly in steps to increase the quantity of burning gas. Also, the exit orifices extend inclinedly upwards and inclinedly laterally toward the center of the heating flue to reduce the flow resistance which opposes the flow of gaseous medium issuing and entering through the slots.

Another example of a process for heating the walls of an oven is disclosed in the German Patent No. 391,501, where the speed of the combustion gas stream is increased in the direction of the flow through the heating chamber or flue by the narrowing of the flow path through the flue. In this manner, the transfer of heat to the oven walls is increased.

German Patent No. 655,948 discloses a heating flue for heating the walls of an oven, or the like, in which the flue is divided into separate heating channels by a wall that extends upwardly through the heating flue. The wall includes openings spaced along its length. The gas and air are introduced into the flue on opposite sides of the separating wall. The gas and air flow upwardly on opposite sides of the wall and pass through the wall openings along the length of the wall into a mixture, for combustion of the gas and air to take place. The wall is sloped or inclined from the vertical at the entrance of the heating flue so that the diameters of the gas and air inlets are different from one another. The wall is positioned so that at the exit of the flue, the separate gas and air channels have equal diameters. In this manner, mixing of the gas and air is controlled to achieve uniform heating of the adjacent walls along the length of the heating flue.

While it is known to redistribute preheated gaseous combustion-supporting agents and preheated lean gas by varying the cross section of the shafts and chambers supplying the combustion media, there is a need for a heating chamber apparatus that effectively controls the flow of gas, air and products of combustion therethrough over a specified distance to achieve controlled combustion in the combustion chamber.

SUMMARY OF THE INVENTION

In accordance with the present invention, there is provided an apparatus for mixing gas and air in a combustion chamber that includes an elongated heating flue having at one end an inlet with a separate feed of gas and air into said heating flue. The heating flue has at an opposite end an outlet for the discharge of the products of combustion of gas and air from the heating flue. A refractory component is positioned in the heating flue between the inlet and the outlet to position the heating flue into a plurality of heating zones. The refractory component includes a plurality of passageways. Each of the passageways extends a preselected length in the heating flue. The refractory component has a plurality of inlets for separately receiving gas and air. The refractory component has a plurality of outlets. The refractory component outlets are located at preselected positions in said heating flue to supply combustion air to the gas to complete combustion over the length of the heating flue.

Further, in accordance with the present invention, there is provided a process for the controlled mixing of gas and air in a combustion chamber that includes the steps of introducing flow of gas and combustion air into an inlet of a combustion chamber. The flow of gas and combustion air is fed separately through passageways of a refractory component extending a preselected length in the combustion chamber. The gas and combustion air are mixed in the passageways to initially achieve substoichiometric combustion of the gas in the refractory component and produce partially combusted gas. The partially combusted gas and unburned gas are discharged from the refractory component in the combustion chamber. Additional combustion air is supplied for mixture with the partially combusted gas and unburned gas in the combustion chamber above the refractory component. Combustion of the partially combusted gas, unburned gas and combustion air is completed in the combustion chamber at preselected locations in the combustion chamber to generate uniform combustion throughout the combustion chamber.

Accordingly, a principal object of the present invention is to provide a process and an apparatus for improving the heating and flow conditions in heating chambers of coke ovens by the use of refractory components, such as, checkers and/or packed spheres, which are resistant to the atmosphere of the heating chamber and withstand temperatures up to 1800 degrees C.

The checkers produce a uniform flow and, if necessary, can even achieve a separate guidance of gas and air over a distance to be specified, which is a function specifically of the height of the oven and the geometric dimensions of the heating chamber.

Preferably, the heating chamber and/or the heating apparatus is divided into different zones, into which gas and combustion air are introduced separately and at different levels. In a first stage, the amount of air necessary for a significantly substoichiometric combustion is added to the gas. Then, in another stage, the unburned gas/exhaust mixture is re-burned with air introduced from outside. In this manner, individual combustion reactions take place, which are fed separately with air. Thus, an approximately uniform combustion with low flame tip temperature can be achieved even over great heights.

As a result of the different height of the checkers over the cross section and the height of the heating chamber and separate guides for the combustion media to the checker discharge, the type of combustion can be selectively controlled as a function of the heat required at the level in question.

Thus, a one-sided or two-sided, pyramid-shaped flame propagation which is graduated over the height of the oven becomes possible. With such a graduated flame propagation, it is not necessary to introduce the combustion air at different heights.

The surfaces of the checker can also be coated with catalyst material, which converts the pollutants formed, e.g. $NO_x$ at the desired point.

The thickness of the web in the checker can also exert an additional influence on the heat storage capacity, which can temporarily compensate for a drop in temperature resulting from an increased removal of heat. In addition, changes in the cross section of the checker can be affected.

When spheres are used as components in accordance with the invention, it becomes possible to fill the heating chamber with ceramic spheres of identical size, leaving an open space of approximately 25% of the flue cross section in the densest packing of the spheres. In this case, in addition to the excellent guidance with intensive mixing of the combustion media, the heat storage capacity of the heating chamber is significantly increased, so that a temporary increase in heat removal required by the process does not lead to temperature drops in the heating flue.

DESCRIPTION OF THE PREFERRED EMBODIMENTS

Figure 1:
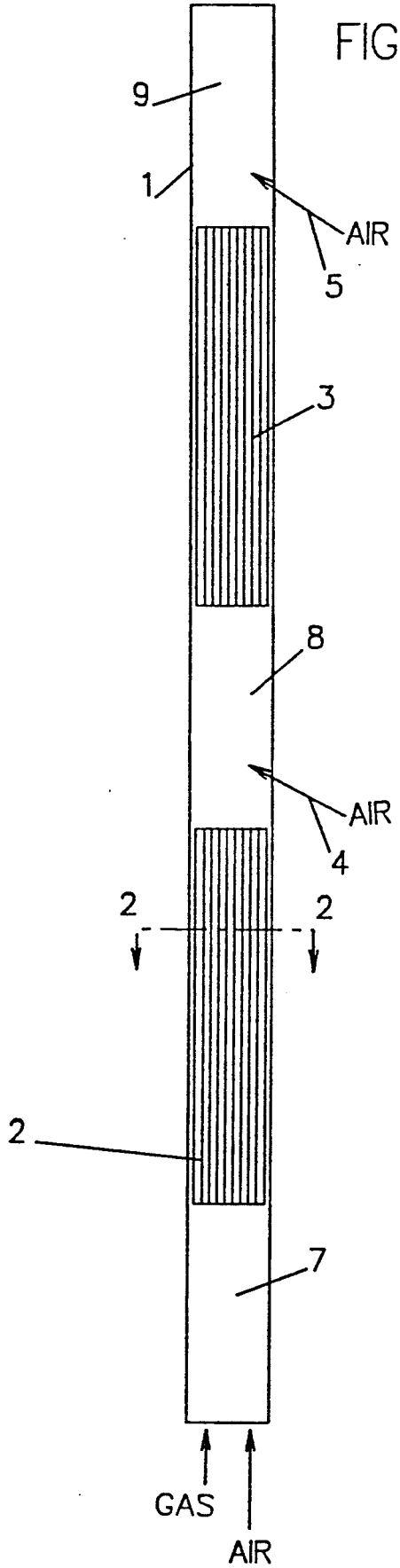
FIG. 1 is a schematic front elevational view of a heating flue of an oven, illustrating checker components positioned in the flue to control the flow of gas and air.

Referring to FIG. 1, there is illustrated a heating flue 1. Heating flue 1 is representative of heating flues disclosed in U.S. Pat. No. 4,412,890 and German Patent Nos. 655,948 and 391,501, which are incorporated herein by reference. The heating flue 1, in one example, has a length of approximately 7650 mm. At the bottom of the heating flue 1, there is provided a gas and air feed inlet into a combustion chamber 7 of flue 1. In the heating flue 1, there are two checker work or checkerboard-shaped refractory components 2 and 3, located one above the other in spaced relation. The components 2 and 3 are constructed of a plurality of air permeable checker bricks which are well known in the art. The checker bricks form a plurality of discrete passageways that extend longitudinally in the heating flue and through which the flow of combustion air is introduced in a controlled manner into mixture with gas. The checker bricks include a web of a preselected thickness which serves to exert an additional influence on the heat storage capacity of the checker component by compensating for a drop in temperature resulting from an increased removal of heat. As will be explained later in greater detail herein, each of the passageways in the checker components 2 and 3 have a preselected length and are selectively positioned along the length of the heating flue.

Both checker components 2 and 3, in the illustrated example, are approximately 2000 mm in length. Thus, each of the components 2 and 3 occupies approximately 26% of the length of the flue 1. The checker component 2 is located approximately 1165 mm above the gas and air feed inlet of combustion chamber 7. The components 2 and 3 are spaced apart. The distance between the checker components 2 and 3 is the same as the distance of the checker component 2 from the gas and air feed inlet of combustion chamber 7. Positioned above the checker components 2 and 3 are additional combustion chambers 8 and 9, respectively.

In the heating flue 1, air is also fed into the flue above the checker components 2 and 3 at inlets 4 and 5 by means of suitable devices, such as, nozzles or the like. At the inlet feed, both air and gas are introduced into the chamber 7 and flow upwardly through the checker components 2 and 3 and chambers 8 and 9, as combustion takes place in heating flue 1.

Figure 2:
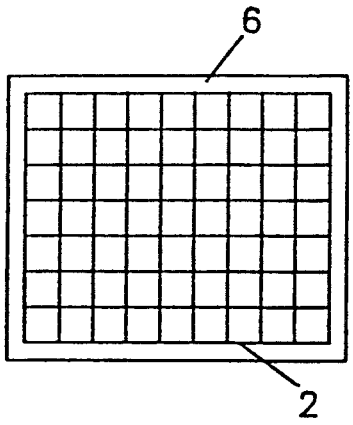
FIG. 2 is a schematic sectional view of the flue and a checker component taken along line 2—2 of FIG. 1.

Referring to FIG. 2, there is illustrated the checker component 2, which is also representative of the checker component 3 in cross section in the flue 1. The checker 2 occupies substantially the entire cross sectional area of the flue 1. In one example, the checkers 2 and 3 have edge lengths of approximately 1165 mm and 1498 mm so that the longitudinal edges of the checker components 2 and 3 are equally spaced at a distance 6 of approximately 83 mm on all sides from the surrounding walls of the heating flue 1. The individual checkers have a square cross section of approximately 50 mm on a side to form the plurality of longitudinally extending passageways in the components 2 and 3. Thus, in the example of the checker construction shown in FIGS. 1 and 2, the checker components 2 and 3 occupy approximately 88% of the cross sectional area of the heating flue 1 along the entire length of the checker components 2 and 3.

Figure 3:
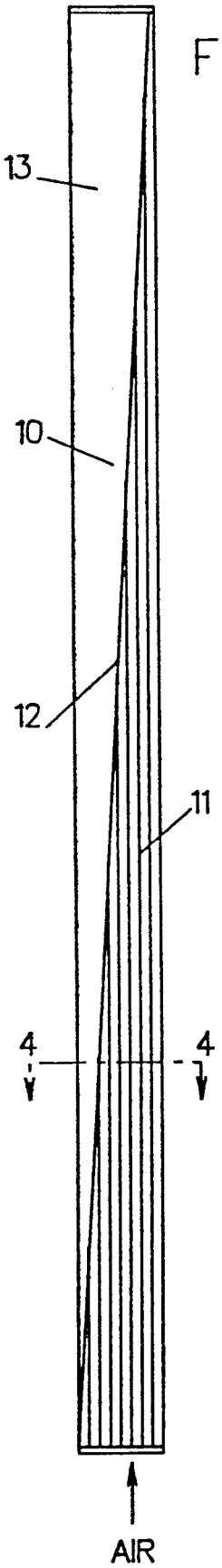
FIG. 3 is a schematic view similar to FIG. 1 of another embodiment of a heating flue, illustrating a single checker component having a cross section that varies in dimension along the length of the flue.
Figure 4:
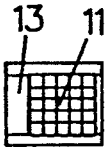
FIG. 4 is a schematic sectional view of the flue and checker component taken along line 4—4 of FIG. 3.
Figure 5:
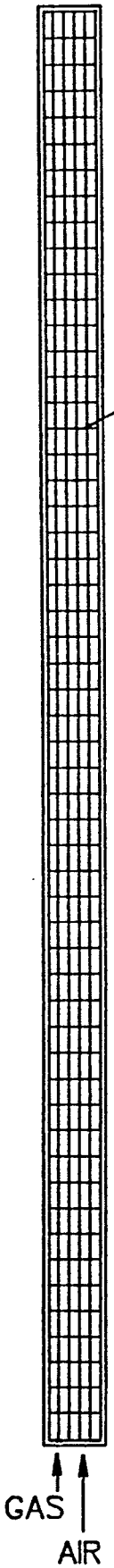
FIG. 5 is schematic side view of the heating flue shown in FIG. 3, illustrating the outlets of the checker component opening into the heating flue along the full length of the flue.

FIGS. 3-5 show another embodiment of a heating flue 10 having the same dimensions as the heating flue 1 described above and illustrated in FIG. 1. The flue 10 includes a unitary checker component 11. In contrast to the heating flue 1, the heating flue 10 includes a checker component 11 having a checker-board or checker work structure, which with all other conditions being identical, where the cross sectional area of the heating flue 10 increases in the upward direction of flow in flue 10. Consequently, the cross sectional area of the checker component 11 decreases linearly in the upward direction of flow. In one example, the cross sectional area decreases from approximately 88% adjacent the heating flue inlet to about 1% adjacent the heating flue outlet. A relevant boundary line 12 is formed between the checkerboard structure and the remainder of the interior of flue 10. The boundary line 12 extends, as seen in FIG. 3, between the upper right corner of the heating flue 10 to the lower left corner of the heating flue 10.

The cross sectional area of the checkerboard structure shown in FIGS. 3-5 is continuous in length but progressively decreases in cross section in the upward flow direction from the bottom to the top. For example, at the bottom of the heating flue, as shown in FIG. 3, the checker component 11 occupies approximately 88% of the entire cross section of the flue 10. The checker component 11 decreases linearly in the upward flow direction. At the midpoint of the flue 10, the cross section of the checker component 11 occupies approximately 50% of the flue cross section. At the uppermost point of the heating flue 10, the cross section of the checker component 11 decreases to a point where it occupies approximately 1% or less of the flue cross section.

Along the surface marked by the boundary line 12, the checker component 11 includes a plurality of air outlets or openings, as shown in FIG. 5, for introducing air into the combustion chamber 13, for mixture with unburned gas and/or partially combusted gas flowing upwardly through chamber 13. Combustion takes place along a boundary line 12 separating the checker component 11 from the remainder of the combustion chamber 13 in the heating flue 10.

Initially at the bottom of flue 10 adjacent the gas and air inlets or openings, substoichiometric combustion occurs. The unburned gas is mixed with the partially combusted gas and flows upwardly for mixture with increasing amounts of air flowing through the refractory component 11 to complete the combustion process. With this arrangement, individual combustion reactions take place along the length of the boundary line 12. This provides uniform air/gas combustion with low flame tip temperature over the height of the heating flue 10. With the embodiment of the present invention shown in FIG. 3, the cross section of chamber 13 increases linearly upwardly as the checker work cross section decreases linearly upwardly.

The profile of the checker component cross section shown in FIG. 3 provides optimum flame control. The flame control is determined, in part, by the use of the checkerboard structure to introduce the gas and combustion air into the heating flue. As seen in FIG. 4, the checkerboard structure occupies approximately two-thirds of the flue cross section at that particular height of the flue.

Figure 6:
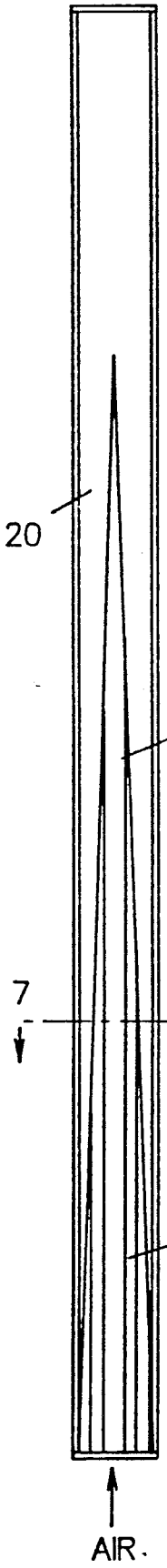
FIG. 6 is a schematic front elevational view of a heating flue, illustrating another embodiment of a single checker component positioned in the heating flue.
Figure 7:
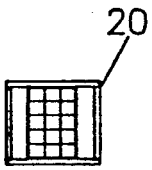
FIG. 7 is a schematic sectional view of the heating flue and checker component taken along line 7—7 of FIG. 6.
Figure 8:
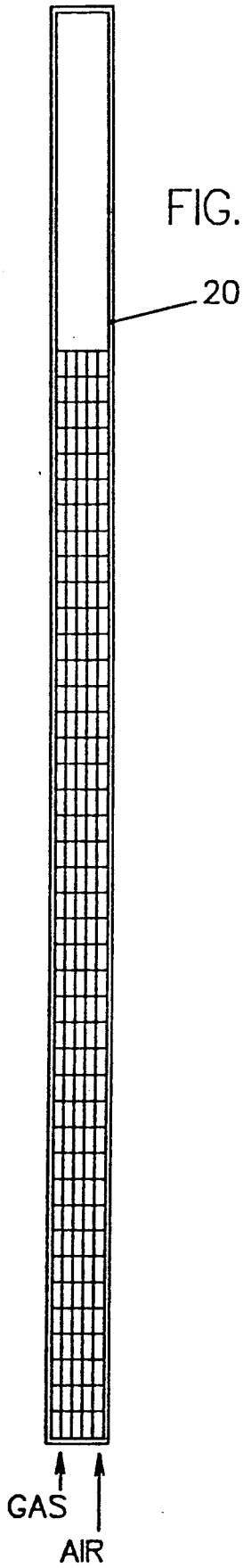
FIG. 8 is a schematic side view of the heating flue with the checker component shown in FIG. 6.

Now referring to FIGS. 6-8, there is illustrated an additional checkerboard structure for a heating flue 20, which is identical to the heating flues 1 and 10, shown in FIGS. 1 and 3. As seen in FIGS. 6 and 8, the checkerboard structure includes checker component 21 constructed of individual checker bricks assembled in the shape of a pyramid. In one example, the pyramid extends to a height of approximately 5660 mm, which is approximately 74% of the total flue height. This configuration of the component 21 provides a flame propagation which has a two-sided pyramidal shape in comparison with the one-sided pyramidal shape of flame propagation generated by the checker-board structure shown in FIG. 3.

With both of the checkerboard structures shown in FIGS. 3 and 6, the flow of gas and combustion air is separately controlled without requiring the combustion air to be introduced externally of the heating flue at different heights. The air is introduced at the bottom of the heating flue, passes through the checkers and enters into a mixture with gas at different heights or levels within the heating flue. Thus, the pyramidal-shaped checkerboard structure provides for controlled mixture of gas and air along the entire length of the heating flue. This permits uniform combustion to be achieved over the height of the heating flue.

With the present invention, individual combustion reactions take place along the length of the flue. This allows control of the flame over the height of the heating flue and accordingly control of the heat over the height of the heating flue. Initially the gas is mixed with small amounts of air to obtain substoichiometric combustion in the heating flue. Then, as the air advances upwardly through the component 21, shown in FIG. 6, the number of air outlets into the heating flue 20 increases to supply additional combustion air to the partially combusted gas and unburned gas, to complete the combustion that has partially taken place. In this manner, combustion with low flame tip temperature is achieved over the height of the heating flue.

Figure 9:
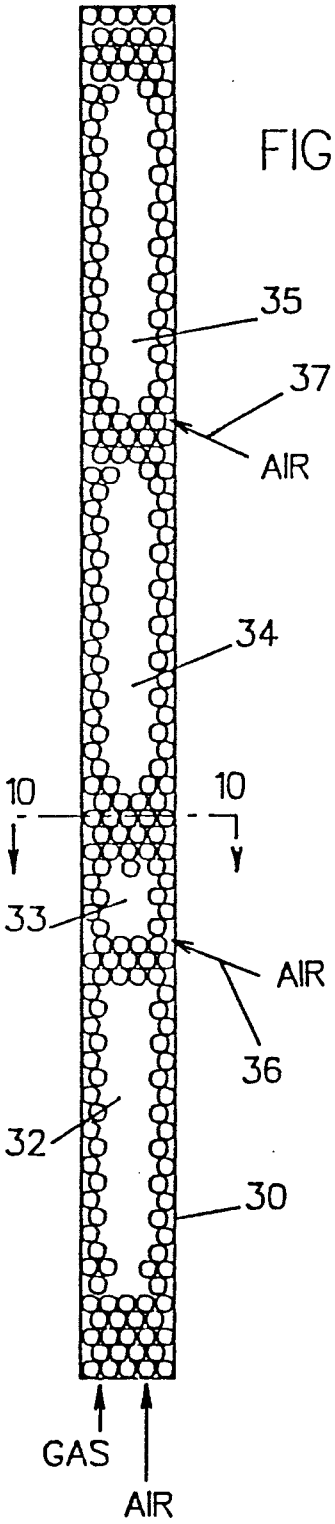
FIG. 9 is a schematic front elevational view of a heating flue, illustrating ceramic spheres packed in a selected density the length of the flue to achieve controlled mixing of gas and air in the heating flue.
Figure 10:
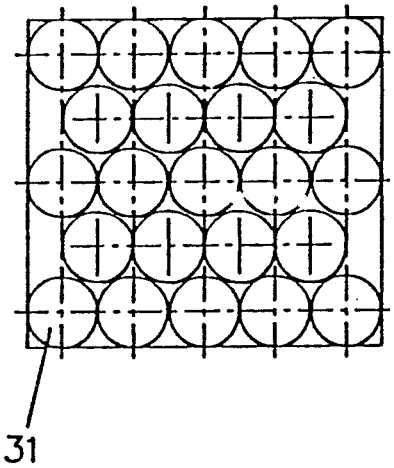
FIG. 10 is a schematic sectional view of the heating flue and packed spheres taken along line 10—10 of FIG. 9.

FIGS. 9 and 10 illustrate a heating flue 30 in which a plurality of refractory spheres 31 are packed in the flue 30 to form a plurality of passageways for the flow of air upwardly through the flue, similar to the flow of air through the checkers described above. The spheres are fabricated of ceramic material and are approximately identical in size.

The density packing of the spheres differs over the length of the heating flue 30 to provide openings or passageways for the flow of gas and air through the flue 30. Cavities or passageways 32, 33, 34 and 35 are formed as combustion chambers with an open cross section in comparison with the point of densest packing of the spheres 31 in the flue, as shown in FIG. 10. As shown in FIG. 10, the spheres 31 are packed to provide an open space of approximately 25% of the flue cross section.

The upper cavity or chamber 35 and the lower cavity or chamber 32, formed by the spheres, are both approximately 1165 mm in length and are both spaced a distance of approximately 500 mm from the nearest end of the heating flue.

The cavity or chamber 33 is approximately 333 mm in length, and the cavity 34 is approximately 1498 mm in length. All of the cavities are approximately 1166 mm wide.

Combustion air is fed into the chambers 32, 33, 34 and 35 at the bottom and through inlets 36 and 37, schematically illustrated in FIG. 9. With this arrangement, the cavity and combustion air feed are arranged to provide optimum flame control.

In summary, one feature of the invention resides broadly in heating chambers in coke ovens, characterized by components for a flame control optimized over the height of the heating flues.

Another feature of the invention resides broadly in an apparatus which is characterized by air permeable checker components 2, 3, 11, 21 and/or packed refractory spheres 31.

Yet another feature of the invention resides broadly in an apparatus which is characterized by the fact that the components are made of ceramic material.

A further feature of the invention resides broadly in an apparatus which is characterized by waste gas guidance in segments.

A yet further feature of the invention resides broadly in an apparatus which is characterized by components which are tapered to become narrower and/or wider along the length of the heating chambers.

Yet another further feature of the invention resides broadly in an apparatus which is characterized by the fact that the components are coated with catalyst material.

An additional feature of the invention resides broadly in an apparatus which is characterized by heating zones or segments formed with checker components 2 and 3 or with a sphere packing 31 in combustion chambers 8, 9, 13, 33, 35 of larger open cross section provided with devices 4, 5, 36, 37 for the feed of combustion air.

A yet additional feature of the invention resides broadly in an apparatus which is characterized by the fact that the checkers 11 and 12 have a number of air outlet openings distributed over at least a portion of the height of the heating flue.

A further additional feature of the invention resides broadly in a process for heating coke ovens by means of heating chambers, into which gas and combustion air are introduced with the use of components in the heating flues which is characterized by the fact that the gas is initially combusted substoichiometrically with only small amounts of air, and additional combustion air in the gas-exhaust gas mixtur ascending in the heating flue is uniformly fed thr gh the components or in stages above the components until complete combustion has taken place.

In further recapitulation of the background information:

In coke ovens, the coking of coal takes place, with the exclusion of air, by indirect heating from heating chambers and by heating flues in the coke oven walls. A feature common to all the heating chambers of the prior art in coke ovens, however, is uncontrolled flow conditions. In some of the heating chambers of the prior art, there are pronounced recirculation flows. U.S. Pat. No. 4,412,890 discloses a coke oven battery that includes heating flues having hollow shaft members formed with orifices at different elevations. The shaft members are connected to regenerators for the supply of preheated gaseous combustion agents. One shaft member is supplied with preheated lean gas, and another shaft is supplied with preheated combustion-supporting air. The shafts are connected to the regenerators. The shafts narrow upwardly in steps. The upwardly-decreasing cross section serves to decrease the quantity of gas issuing from the exit orifices at each orifice further up the flue. On the other hand, the cross sections of the flue chambers widen upwardly in steps to increase the quantity of burning gas. Also, the exit orifices extend inclinedly upwards and inclinedly laterally toward the center of the heating flue to reduce the flow resistance which opposes the flow of gaseous medium issuing and entering through the slots.

Another example of a process for heating the walls of a coke oven is disclosed in the German Patent No. 391,501, where the speed of the combustion gas stream is increased in the direction of the flow through the heating chamber or flue by the narrowing of the flow path through the flue. In this manner, the transfer of heat to the coke oven walls is increased.

German Patent No. 655,948 discloses a heating flue for heating the walls of a coke oven, or the like, in which the flue is divided into separate heating channels by a wall that extends upwardly through the heating flue. The wall includes openings spaced along its length. The gas and air are introduced into the flue on opposite sides of the separating wall. The gas and air flow upwardly on opposite sides of the wall and pass through the wall openings along the length of the wall into a mixture, for combustion of the gas and air to take place. The wall is sloped or inclined from the vertical at the entrance of the heating flue so that the diameters of the gas and air inlets are different from one another. The wall is positioned so that at the exit of the flue, the separate gas and air channels have equal diameters. In this manner, mixing of the gas and air is controlled to achieve uniform heating of the adjacent walls along the length of the heating flue.

All, or substantially all, of the components and methods of the various embodiments may be used with at least one embodiment or all of the embodiments, if any, described herein.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicants' option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A process for the controlled mixing of gas and air in an apparatus for mixing gas and air in a heating chamber of a coke oven, said apparatus comprising:

an elongated heating flue having at one end an inlet for the separate feed of gas and air into said heating flue, to initially achieve partial combustion of the gas;

said heating flue having at an opposite end an outlet opposite said one end, said outlet being for the discharge of products of combustion of the gas and air from said heating flue;

a component positioned in said heating flue between said inlet and said outlet to partition said heating flue into a plurality of combustion zones, said plurality of combustion zones comprising a first combustion zone and a second combustion zone;

said component including a plurality of passageways, each of said passageways extending in said heating flue;

said component having a plurality of inlets for receiving partially combusted gas from said first combustion zone;

said component having a plurality of outlets for discharging partially combusted gas from said component passageways into said second combustion zone; and means for supplying additional combustion air, in the vicinity of said component outlets, to the partially combusted gas to further combust the partially combusted gas;

said process comprising the steps of:

introducing flow of gas and combustion air through the inlet of the heating flue and into the first combustion zone;

partially combusting the gas and combustion air in the first combustion zone;

feeding the partially combusted gas through the passageways of the component;

discharging the partially combusted gas from the component into the second combustion zone;

supplying additional combustion air for mixture with the partially combusted gas in the second combustion zone at the outlet of the component; and further combusting the partially combusted gas in the heating flue at the second combustion zone.

2. A process for the controlled mixing of gas and air in a heating chamber of a coke oven, said heating chamber comprising:

an elongated heating flue having at one end an inlet for the separate feed of gas and air into said heating flue;

said heating flue having at an opposite end an outlet opposite said one end, said outlet being for the discharge of products of combustion of the gas and air from said heating flue;

a combustion chamber within said heating flue;

a component positioned in said heating flue between said inlet and said outlet to partition said combustion chamber into a plurality of combustion zones;

said component including a plurality of passageways, said passageways extending a plurality of different lengths in said heating flue;

each of said plurality of passageways having a passageways inlet, said passageway inlets receiving air from said heating flue inlet; and each of said plurality of passageways having a passageway outlet, each of said passageway outlets located at a preselected position in said heating flue, said preselected position of said passageway outlet depending on the length which said passageway extends in said heating flue, said passageway outlets supplying combustion air to the gas, to combust the gas along the preselected positions of said passageway outlets;

said process comprising the steps of:

introducing separate flows of gas and combustion air into the inlet of the heating flue of the heating chamber of the coke oven;

feeding the combustion air through the passageways of the component;

supplying the combustion air to the combustion chamber at the outlets of the passageways of the component; and combusting the gas with the combustion air in the combustion chamber at the outlets of the passageways of the component.

3. A process as defined by claim 2, which includes:

mixing combustion air with the gas along a boundary line separating the refractory component outlets from the combustion chamber; and generating combustion of the mixture of combustion air and gas along the length of the boundary line, to provide uniform combustion of the gas and air over the length of the combustion chamber.

4. A process as defined in claim 3, which includes:

extending the boundary line in a preselected profile between the inlet and the outlet of the combustion chamber.

5. A process as defined in claim 4, which includes:

extending the boundary line in a pyramidal profile narrowing upwardly in the combustion chamber from the inlet to a tip at a preselected height in the combustion chamber.

6. Apparatus for mixing gas and air in a heating chamber of a coke oven, said apparatus comprising:

an elongated heating flue having at one end an inlet for the separate feed of gas and air into said heating flue, to initially achieve partial combustion of the gas;

said heating flue having at an opposite end an outlet opposite said one end, said outlet being for the discharge of products of combustion of the gas and air from said heating flue;

a component positioned in said heating flue between said inlet and said outlet to partition said heating flue into a plurality of combustion zones, said plurality of combustion zones comprising a first combustion zone and a second combustion zone;

said component including a plurality of passageways, each of said passageways extending in said heating flue;

said component having a plurality of inlets for receiving partially combusted gas from said first combustion zone;

said component having a plurality of outlets for discharging partially combusted gas from said component passageways into said second combustion zone; and means for supplying additional combustion air, in the vicinity of said component outlets, to the partially combusted gas to further combust the partially combusted gas.

7. Apparatus as defined by claim 6, wherein said component is constructed of at least one of;

a plurality of checker bricks, each of said checker bricks having a web structure forming openings therethrough where said checker bricks are assembled to align said openings to form said component passageways, and a plurality of spheres.

8. Apparatus as defined by claim 7, wherein:

said checker bricks and said spheres are fabricated of ceramic material.

9. Apparatus as defined by claim 8, wherein:

said checker bricks and said spheres comprise a catalyst coating for converting pollutants.

10. Apparatus as defined by claim 9 wherein:

said ceramic material is a refractory material;

said component comprises at least two component portions, such that said plurality of combustion zones comprises a third combustion zone;

said heating flue is approximately 7650 millimeters in length;

said component portions are each approximately 2000 millimeters in length;

said component portions have cross-section dimensions of approximately 1165 millimeters by approximately 1498 millimeters;

said component portions are space from said heating flue approximately 83 millimeters on all sides; and said first, second, and third combustion zones are each approximately 1165 millimeters in length.

11. An apparatus for heating a coke oven comprising:

an elongated heating flue having at one end an inlet for the separate feed of gas and air into said heating flue;

said heating flue having at an opposite end an outlet opposite said one end, said outlet being for the discharge of products of combustion of the gas and air from said heating flue;

a combustion chamber within said heating flue;

a component positioned in said heating flue between said inlet and said outlet to partition said combustion chamber into a plurality of combustion zones;

said component including a plurality of passageways, said passageways extending a plurality of different lengths in said heating flue;

each of said plurality of passageways having a passageway inlet, said passageway inlets receiving air from said heating flue inlet; and each of said plurality of passageways having a passageway outlet, each of said passageway outlets located at a preselected position in said heating flue, said preselected position of said passageway outlet depending on the length which said passageway extends in said heating flue, said passageway outlets supplying combustion air to the gas, to combust the gas along the preselected positions of said passageway outlets.

12. Apparatus as defined by claim 11, wherein:

said component has a cross sectional area occupying in a range between 1% to 88% of the cross sectional area of said heating flue.

13. Apparatus as defined by claim 11, wherein:

said component has a cross sectional area which varies linearly along the length of said heating flue between said inlet and said outlet thereof.

14. Apparatus as defined by claim 13, wherein:

said component cross sectional area decreases linearly in the direction of gas and air flow between said heating flue inlet and outlet.

15. Apparatus as defined by claim 14, wherein:

said component extends from adjacent said heating flue inlet where said component has a maximum cross sectional area to a preselected height in said heating flue where said refractory component has a minimum cross sectional area to form a pyramidal profile.

16. Apparatus as defined by claim 14, wherein:

said refractory component has a length which extends a preselected height into said heating flue between said inlet and said outlet thereof.

17. Apparatus as defined by claim 16, wherein:

said component passageway outlets each extend to a preselected height in said heating flue to form a boundary line for separating said component from said combustion chamber;

said boundary line being continuous in length and varying in height in said heating flue between said inlet and said outlet thereof; and said component passageway outlets being positioned along said boundary line to introduce air into said heating flue for mixture with the gas to generate combustion along the length of said boundary line.

18. Apparatus as defined by claim 17, wherein:

said component is constructed of a plurality of checker bricks, each of said checker bricks having a web structure forming openings therethrough where said checker bricks are assembled to align said openings to form said component passageways.

19. Coke oven as defined by claim 18, wherein:

said checker bricks are fabricated of ceramic material.

20. Apparatus as defined by claim 19, wherein:

said checker bricks comprise a catalyst coating for converting pollutants;

said ceramic material is a refractory material; and said heating flue is approximately 7650 millimeters in length.

* * * * *